US005674164A

United States Patent [19]

Kravitz

[11] Patent Number: 5,674,164

[45] Date of Patent: Oct. 7, 1997

[54] EXERCISE DEVICE

[76] Inventor: Leonard R. Kravitz, 518 Wedgewood Dr., Oxford, Miss. 38655

[21] Appl. No.: 629,050

[22] Filed: Apr. 8, 1996

[51] Int. Cl.[6] ..... A63B 22/02

[52] U.S. Cl. ..... 482/126; 482/124; 482/121; 482/122

[58] Field of Search ..... 482/121, 122, 482/126, 49, 124

[56] References Cited

U.S. PATENT DOCUMENTS

| | | | |
|---|---|---|---|
| D. 341,401 | 11/1993 | Reichman . | |
| D. 367,901 | 3/1996 | Real . | |
| 552,971 | 1/1896 | Sandow . | |
| 2,021,801 | 11/1935 | Meyer . | |
| 2,529,347 | 11/1950 | Mohler et al. . | |
| 3,655,185 | 4/1972 | Kane . | |
| 4,023,796 | 5/1977 | Kusmer . | |
| 4,169,590 | 10/1979 | Johansen . | |
| 4,483,533 | 11/1984 | Mangiapane . | |
| 4,861,022 | 8/1989 | Boatcallie | 482/126 |
| 5,026,050 | 6/1991 | Leung et al. . | |
| 5,399,138 | 3/1995 | Jones . | |
| 5,490,826 | 2/1996 | Rose . | |

FOREIGN PATENT DOCUMENTS

| | | | |
|---|---|---|---|
| 1428827 | 11/1968 | Germany | 482/126 |

OTHER PUBLICATIONS

Workout guide and promotional material for the "Thighmaster Plus" exerciser by Thighmaster Corporation, P.O. Box 17617, Beverly Hills, CA 90209.

Workout guide for the "Buttmaster" exerciser sold by Thighmaster Corporation, P.O. Box 17617, Beverly Hills, CA 90209.

*Primary Examiner*—Lynne A. Reichard

[57] ABSTRACT

An exercise device for hips, thighs and buttocks is provided which has two elongated arms that pivotably linked together at their proximal ends and that are associated with a pivotable body engagable plate at each of their distal ends. An arcuate tree is medially joined across each proximal end permits a yielding compression biasing member, such as an elastomeric band, to be associated with adjacent respective tree ends for producing either lateral compression force of lateral extension force between the plates. The device makes possible a variety of new and very useful exercises for hips, thighs and buttocks.

30 Claims, 4 Drawing Sheets

EXERCISE DEVICE

FIELD OF THE INVENTION

This invention lies in the field of exercise devices, particularly devices suitable for exercising upper legs including thighs and buttocks.

BACKGROUND OF THE INVENTION

Exercising devices for strengthening thigh muscles are known in the art. Sandow U.S. Pat. No. 552,971 (1896) and Real U.S. Des. Pat. No. 367,901 (1996), for example, disclose relatively large floor-associated exercise devices for thighs that are expensive and lack portability.

Although smaller, portable thigh exercise devices have been developed, they have limitations. Most notably, such exercise devices usually are capable of exerting forces in only a single lateral direction, i.e., inwardly or outwardly. For example, Mangiapane U.S. Pat. No. 4,483,533 (1984), Leung et al. U.S. Pat. No. 5,026,050 (1991) and Reichman U.S. Des. Pat. No. 341,401 (1993) disclose devices that are each believed to exert a force only in a laterally outward direction. As a result, such exercise devices do not permit the user to strengthen thigh muscles uniformly (in all directions).

There is a long felt need in the art for a new exercise device for thighs and the like which is small, easily stored and portable, and which is effective for exerting either lateral compression (adduction), lateral extension (abduction), and backwards extension (hip extension) loads that are regulatable (i.e., user selectable). The present invention satisfies this need.

SUMMARY OF THE INVENTION

This invention is directed to an exercise device that is particularly suitable for upper legs (including thighs, hips and buttocks). The device has two elongated arms that have their respective proximal end regions pivotably linked together by links so that their respective distal ends are articulatable towards and away from one another. Each arm's distal end is associated with a body engagable plate. Each arm's proximal end is fixed to a medial portion of an arcuately and longitudinally extending tree having respective projecting outer and inner ends.

The invention is also directed to new and improved methods for accomplishing exercise particularly of thighs, hips and buttocks muscles which methods utilize and are made possible by the exercise device of this invention.

In use, each plate is engagable by a user with a corresponding inner or outer side portion of a different one of the left and right thighs. When the lower ends of each tree are yieldingly urged together by a compression biasing member that is extended therebetween and also when each plate is concurrently engaged with a different but preferably opposed thigh outside portion, then the respective plates are urged against opposite thigh sides and towards one another. The thigh muscles in each leg can be employed to urge the thighs apart laterally and thereby overcome this laterally applied yielding compressive biasing force or load, thereby exercising such muscles.

When, alternatively, the upper ends of each tree are yieldingly being urged together by a compression biasing member that is extended therebetween, and also when each plate mean is concurrently engaged with a different but preferably opposed thigh inside portion, then the respective plates are urged against adjacent thigh sides and away from each other. The thigh muscles in each leg can be employed to urge the thighs together laterally and thereby overcome this laterally applied yielding extensive biasing force or load, thereby exercising such muscles.

Preferably, each plate is pivotably associated with the distal end of each arm.

The compression biasing member that is applied either to achieve the compressive or extensive force or load that is applied upon the arms is preferably a closed (or endless) loop (or band) of elastomeric (or rubber-like) material which is adapted to exert a yielding force when extended and which is adapted to return to its initial or relaxed configuration after release from extension. Preferably, such a closed loop exerts a uniform compression force when extended over a relatively wide range of extension distances. Alternatively, the compression biasing means can comprise a spring, such as a coiled steel spring, if desired.

Preferably, each of the arm is laterally and outwardly convexly curved for ease in grasping and device manipulation. Preferably the pivot axis at the proximal end of each respective arm means is in spaced, parallel relationship relative to the other thereof, and preferably the pivot-axis of each plate is in spaced, parallel relationship to the other thereof and also to the pivot axis of each arm.

Preferably, each arm and its associated plate and tree is adapted to be a virtual mirror image of the other. Preferably, each arm and it's respective associated plate and tree is in a bilaterally symmetrical relationship relative to the other.

Preferably, embodiments of the inventive exercise device are comprised of strong light weight materials, such as molded plastic or metal. Preferably, where practical, elements of an embodiment of the inventive device are formed as integral subassemblies to minimize the number of separate component parts.

Particularly preferred methods of this invention are those which involve the application of yieldingly applied compression loads to thighs followed by the application of yieldingly applied extension loads to thighs (or vice versa) by using the inventive device for applying such loads and while manually supporting the inventive device generally perpendicularly to the thighs.

Other and further objects, aims, purposes, features, advantages, embodiments, usages and the like will be apparent to those skilled in the art from the present specification taken with the accompanying drawings and the appended claims.

DETAILED DESCRIPTION

Figure 1:
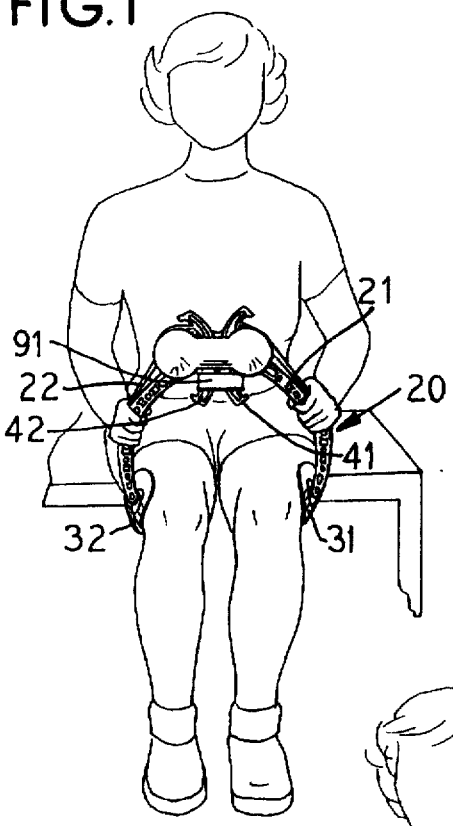
FIG. 1 is an environmental perspective view in diagrammatic form illustrating one method of using an embodiment of the exercise device of this invention to develop the lateral extension (abductors and buttocks) muscles.

FIGS. 1–11 illustrate one embodiment 20 of an exercise device of the present invention that is particularly well adapted for exercising the upper legs including the thighs and the buttocks. Exercise device 20 employees a pair of elongated arm members 21 and 22. Each arm member 21 and 22 has a proximal end region 23 and 24, respectively, and a distal end region 26 and 27, respectively.

Device 20 incorporates a pair of link members 28 and 29 that pivotably interconnect the proximal end regions 23 and 24 so that the arm members 21 and 22 are each pivotably movable towards and away from one another.

Device 20 also incorporates a pair of body engagable plate members 31 and 32. Each plate member 31 and 32 is pivotably associated with a different one of the distal regions 26 and 27, respectively.

It is presently preferred to have each plate member 31 and 32 be pivotably mounted to its associated distal region 26 and 27 so that each plate member 31 or 32 can be pivoted through an included angle of at least about 180° whereby the front plate face can face laterally inwards or outwards. However, alternative plate arrangements (including configurations and mounting) can be employed in a device of the invention as those skilled in the art will readily appreciate. For example, the plates can be fixed longitudinal extensions of the distal regions 26 and 27 or the plates can be detachable from, and relocatable relative to, their respective distal regions 26 and 27.

Device 20 further incorporates a pair of arcuately extending tree members 33 and 34. A mid-region 36 and 37 of each tree member 33 and 34, respectively, is fixedly joined across a different one of the proximal end regions 23 and 24. An upper end portion 38 and 39 of each tree member 33 and 34, respectively, extends outwardly and upwardly (relative to arm members 21 and 22 and link members 28 and 29) beyond the link members 28 and 29. A lower end portion 41 and 42 of each tree member 33 and 34, respectively, extends inwardly and downwardly (relative to arm members 21 and 22 and link members 28 and 29) beyond the link members 28 and 29. Preferably, the tree members 33 and 34 are each integrally formed (by molding or the like) with their respective associated proximal end regions 23 and 24. The tree members 33 and 34 can be considered to be an integral part of the arms 21 and 22, if desired.

Figure 9:
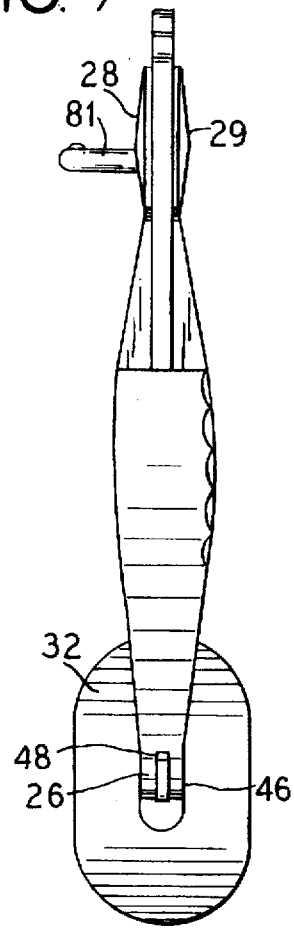
FIG. 9 is an edge elevational view similar to FIG. 5, but showing the opposite edge of the device embodiment.
Figure 10:
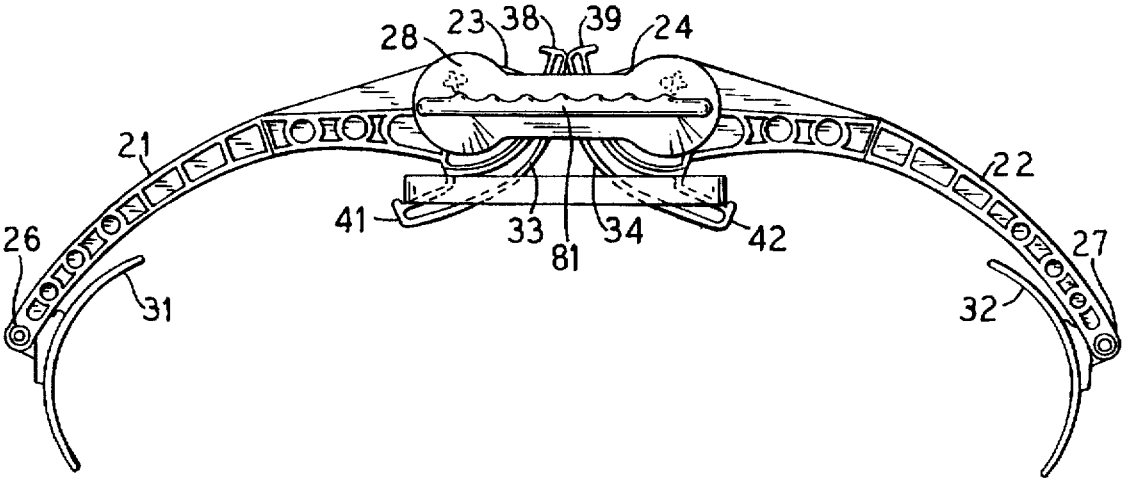
FIG. 10 is a view similar to FIG. 4, but showing the device embodiment in its position of maximum arm opening.
Figure 11:
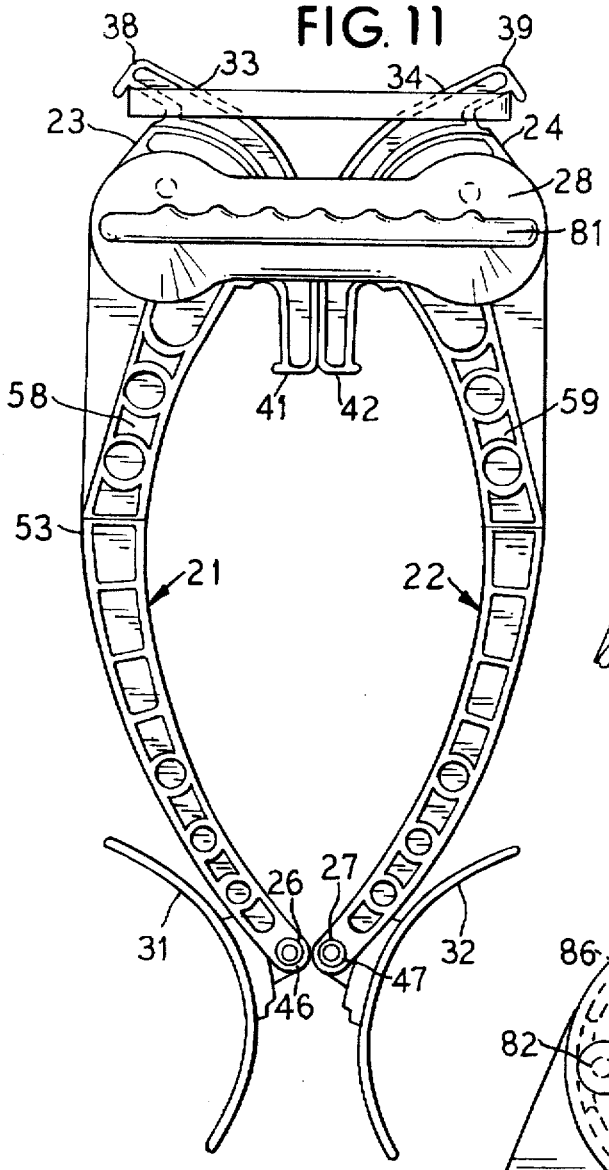
FIG. 11 is a view similar to FIG. 4, but showing the device embodiment in the operative configuration thereof that is employed for the device embodiment usage illustrated in FIG. 2.
Figure 13:
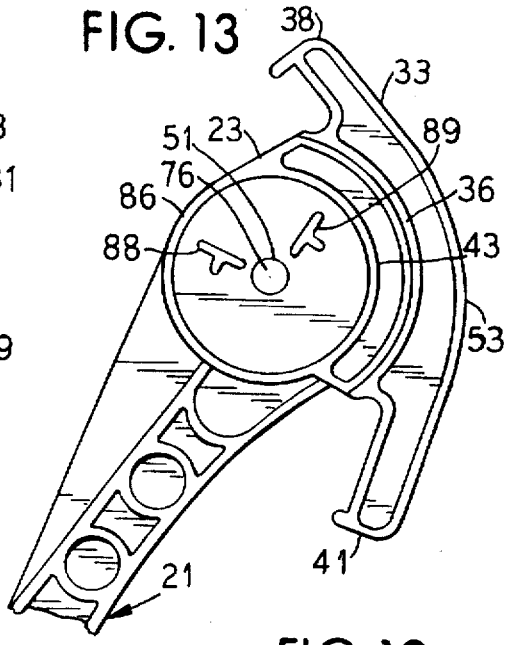
FIG. 13 is a view similar to FIG. 12, but with the overlying link member removed.
Figure 12:
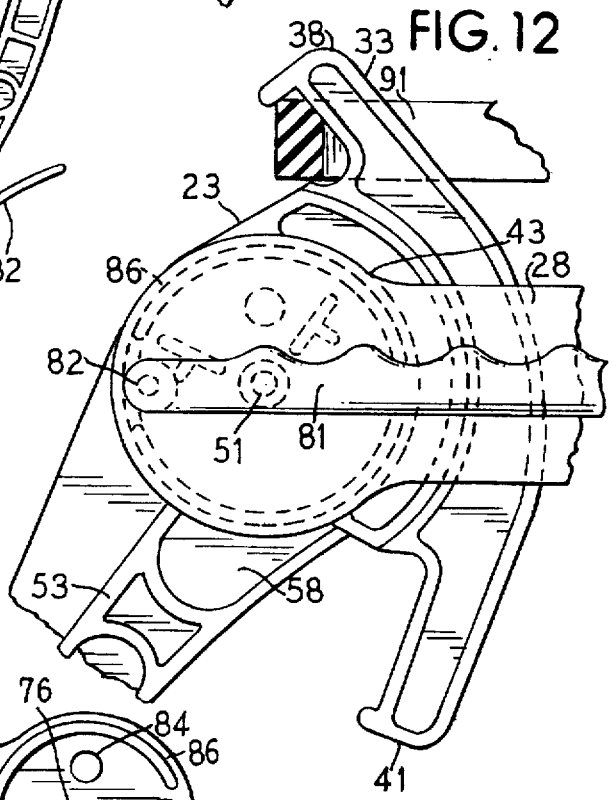
FIG. 12 is a fragmentary enlarged view of the proximal region of one arm as shown in FIG. 4, some parts thereof being broken away and some parts thereof being shown in phantom.
Figure 14:
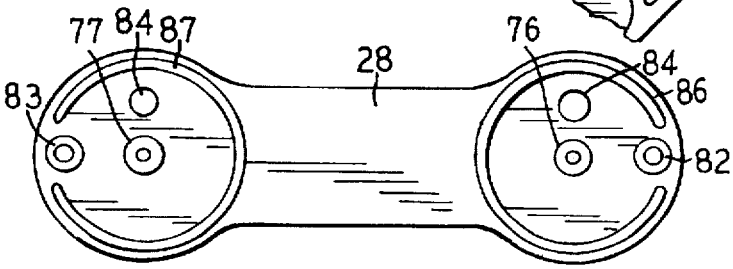
FIG. 14 is a view of the back side of the link member shown fragmentarily in FIG. 12 (the link member being turned over end to end).

The interrelationship between the arm members 21 and 22, the link members 28 and 29, and the tree members 33 and 34 is such that there is no interference with and during articulation movements involving the arm members 21 and 22 relative to each other and to the link members 28 and 29 except at predetermined end positions of the arm members 21 and 22. A predetermined terminal inward end position for the arm members 21 and 22 is illustrated in FIG. 10 where opposed surfaces of lower end portions 41 and 42 of the tree members 33 and 34, respectively, are in abutting contact with one another. A predetermined terminal outward end position for the arm members 21 and 22 is illustrated in FIG. 9 where opposed surfaces of upper end portions 38 and 39 of the tree members 33 and 34, respectively, are in abutting contact with one another.

Preferably, and as shown, each of the arm members 21 and 22 is laterally and outwardly convexly curved for ease in grasping and in device 20 manipulation during usage by an exercising user. Preferably, and as shown, each of the arm members 21 and 22 is provided along its inner and outer sides with a transversely broadened, flattened, generally peripherally located and continuously extending flange 43 and 44, respectively. A plurality of cross ribs 46 and 47 on each arm member 21 and 22, respectively, are provided that extend laterally between adjacent inner and outer side portions of the flanges 43 and 44. Interconnecting rigidifying and strengthening webs 46 and 47 comprised of the same construction material as each arm member 21 and 22 medially extend between respective adjacent portions of ribs 46 and flanges 43 in arm member 21 and ribs 47 and flanges 44 in arm member 22. As one approaches the distal end 26 and 27 of each respective arm 21 and 22, a lateral taper is provided, and, at each distal end 26 and 27, the flanges 43 and 44 form a continuous thickened region through which a transverse aperture 46 and 47 extends. Each aperture 46 and 47 is medially and perpendicularly intersected by a longitudinal and laterally extending end slot 48 and 49, respectively (see FIGS. 4 and 8). Each arm member 21 and 22 along its length is preferably and as shown medially transversely thickened for ease in grasping by a user (see FIGS. 4 and 8).

Figure 5:
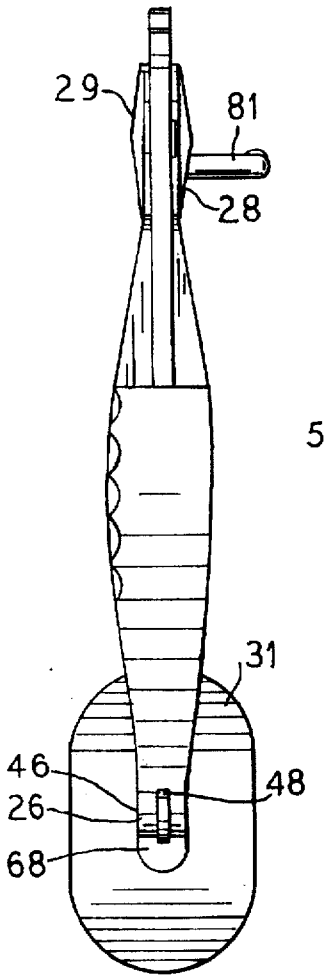
FIG. 5 is an edge elevational view of the device embodiment of FIG. 4.
Figure 4:
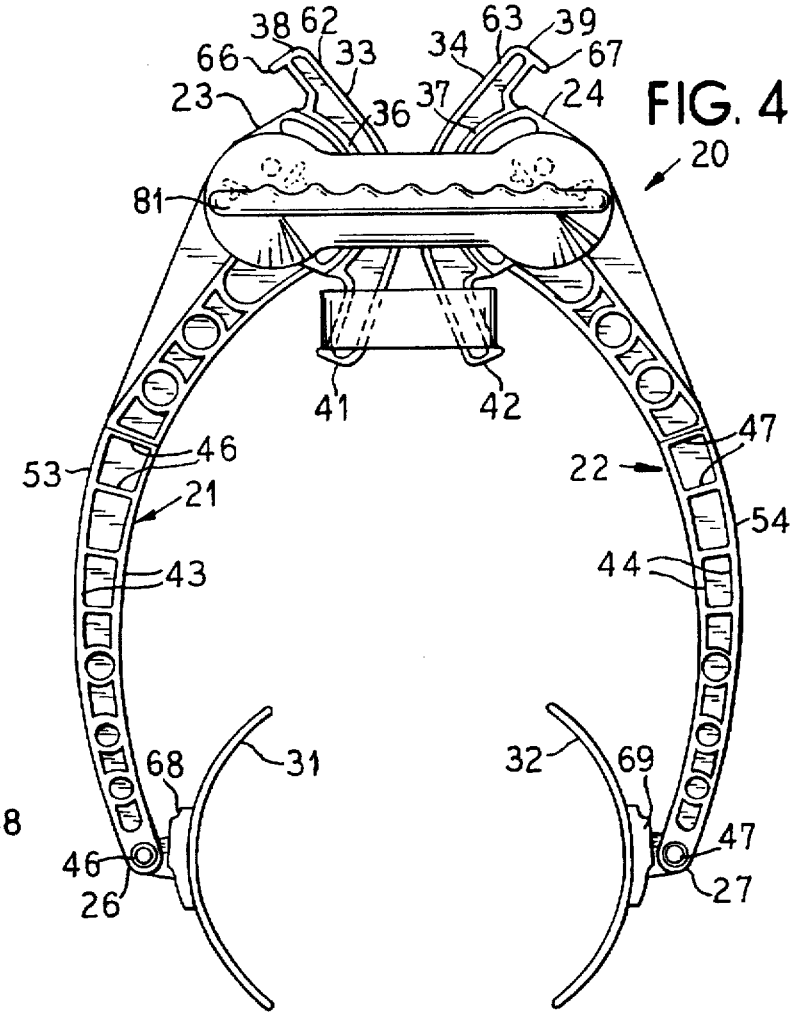
FIG. 4 is a front side elevational view of the device embodiment of FIGS. 1–3 shown in the operative configuration thereof that is employed for the mode of exercise illustrated in FIGS. 1 and 3.
Figure 7:
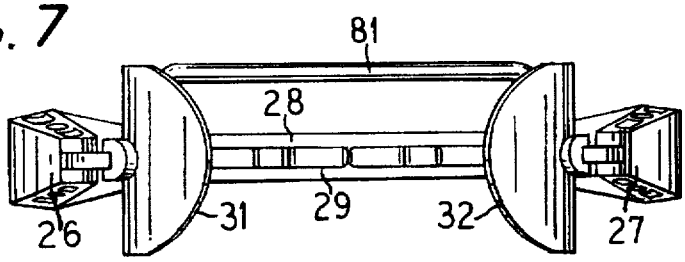
FIG. 7 is a bottom plan view of the device embodiment of FIG. 4.
Figure 8:
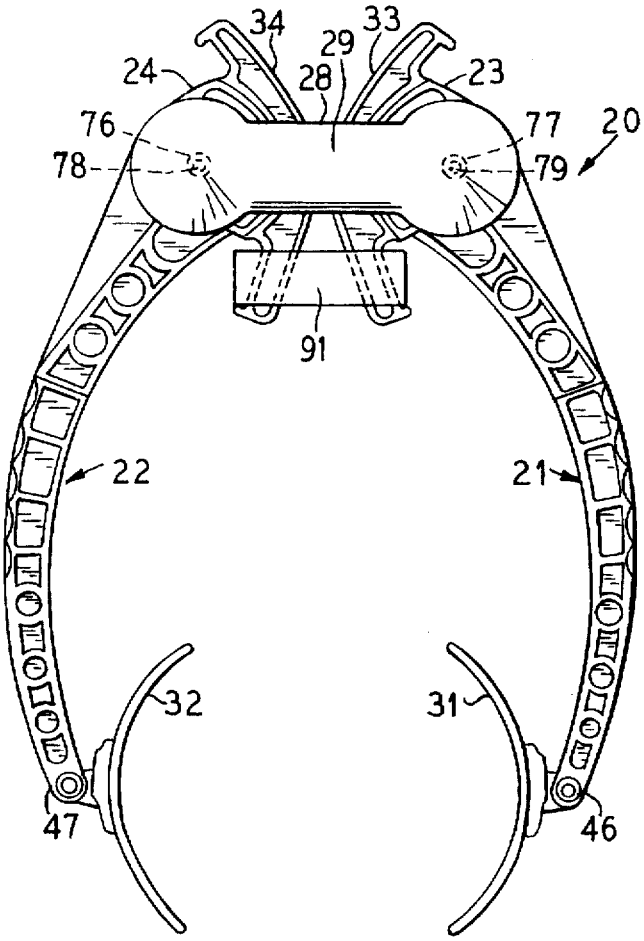
FIG. 8 is a back side elevational view of the device embodiment of FIG. 3.

The medially thickened region of each arm member 21 and 22 is preferably provided with a plurality of longitudinally adjacent finger receiving grooves which are preferably located on a rear side of each arm member as shown, for example, in FIG. 5. Such grooves can be molded into each arm member 21 and 22 as formed. Alternatively, if desired, at least a portion of the medial region of each arm member 21 and 22 can have molded thereover a resilient or cushioning plastic layer that can be foamed, if desired, and that has formed in external surface portions thereof finger receiving grooves.

Preferably and as shown, each of the proximal end regions 23 and 24 is laterally enlarged so that a circular configuration for each peripheral flange 43 and 44, respectively, is there achieved for each arm 21 and 22. Centrally within the circular region thus defined a transverse aperture 51 and 52 is defined through each proximal end 23 and 24, respectively. A wing-like, longitudinally extending, outwardly projecting reinforcing rib 53 and 54 is provided integrally and medially between and along outside portions of the respective flanges 43 and 44 of each arm member 21 and 22 adjacent to the proximal end regions 23 and 24.

For purposes of positioning and locating each tree member 33 and 34 relative to its associated respective arm member 21 and 22, an arcuately extending positioning flange 56 and 57 is provided along a circumferential portion of the circular configuration at each proximal end region 23 and 24 in radially spaced relationship to the respective apertures 51 and 52. The area between adjacent portions of flange 43 and flange 56 and flange 44 and flange 57 is provided with a rigidifying and strengthening web 58 and 59, respectively.

The concave mid-region 36 and 37 of tree members 33 and 34, respectively, is configured to be in adjacent contacting relationship with the radially adjacent (relative to apertures 51 and 52) positioning flange 56 and 57, respectively. Each of the tree members 33 and 34, preferably and as shown, includes a continuously peripherally extending and transversely projecting flange 61 and 62 and an enclosed rigidifying and strengthening web 63 and 64, respectively. Each opposite end 38 and 41 of the tree member 33 and each opposite end 39 and 42 of the tree member 34 is provided with a relatively short, laterally outstanding hook-like projection 66 and 67, respectively.

Those skilled in the art will appreciate that, while the arm members 21 and 22 and the tree members 33 and 34 can be separately formed, it is convenient and preferred to form same as an integral unit, that is, as pairs 21/33 and 22/34, in a molding operation or the like. Various configurations and structures can be utilized for the arm members and the tree members as those skilled in the art will appreciate. Preferably, such members are of light weight, strong construction and are comprised of a metal such as aluminum, magnesium, alloy thereof, or the like, or of a molded plastic, such as a polyolefin (preferably polyethylene), polyester, polyamide, polyimide, mixtures thereof, or the like. Preferably, in the assembled device 20, each arm member 21 and 22, and also each tree member 33 and 34, is like a mirror image of the other. Preferably, a device 20 is bilaterally symmetrical. Preferably, and as illustrated herein, elements of a device 20 are formed as integral subassemblies to minimize the number of separate component parts.

Each of the plate members 31 and 32 is preferably formed of a molded metal or plastic such as above-indicated for the arm members 21 and 22 and the tree members 33 and 34. Each of the plate members 31 and 32 is curved preferably in the form of a cylindrical segment so that the concave or front side thereof is adapted for fitting against either an inside or an outside surface portion of the thigh (left or right) above the knee of a user. This plate curvature is preferably large enough in radius so as to provide a comfortable association of such a plate member with most user thighs. The convex or back side of each plate member 31 and 32 conveniently and preferably provided with a central elevated platform region 68 and 69, respectively.

A leaf 71 upstands from platform 68 and a leaf 72 upstands from platform 69. Leaf 71 is adapted to slidably extend in slot 48 while leaf 72 is adapted to slidably extend in slot 49. Each leaf 71 and 72 is provided with a central aperture. When a rivet 73 and 74 (or a nut and bolt arrangement, or like pivot means) is extended through each aperture 46 and 47 with the leaf 71 and 72 aperture being journaled thereon, the plate members 31 and 32 are pivotably associated with their respective distal ends 26 and 27 with the curvature axis (not detailed) of each concave front plate side being generally parallel to the axis of the respective associated rivets 73 or 74, as the case may be. Thus, each plate 31 or 32 is adapted to pivot so that when its associated respective distal end 26 or 27 is adjacent the inside or the outside of a thigh, then that plate is pivotable so as to be engagable with such adjacent thigh.

As illustrated in FIG. 10, the limit of outward pivotability occurs when the platform 68 or 69, as the case may be, abuts against an adjacent outside surface portion of the associated arm member 21 or 22. Similarly, the limit of inward pivotability occurs when a platform 68 or 69 abuts against an adjacent inside surface portion of the associated arm member 21 or 22 as illustrated in FIG. 9. Preferably, the pivot axis at the proximal end 23 and 24 of each arm member 21 and 22 is in spaced parallel relationship relative to the other thereof. Preferably, the pivot axis of each plate member 31 and 32 is in spaced, parallel relationship relative to the other thereof. Preferably, the pivot axis of each plate member 31 and 32 is in spaced parallel relationship to the pivot axis of each arm member 21 and 22.

Conveniently and preferably, the concave outer surface of each plate member 31 and 32 is provided with a resilient cushioning layer (not shown), such as a polyurethane foam layer over covered with a layer of fabric, imitation leather, or the like, as desired.

The arm members 21 and 22 are preferably and as shown located in spaced, adjacent coplanar relationship to each other. Although a single link member can be used, two are preferred as shown. The link members 28 and 29 are located in overlying relationship relative to each other, each one being on a different opposing side of the proximal ends 23 and 24. The link member 28 and the link member 29 are each comprised of a separately formed material, such as a molded plastic or metal as above characterized, in relation to the arm members 21 and 22 and the tree members 33 and 34.

The link member 28 (which here has a "dog bone" type of elongated and rounded opposite end configuration in plan view) is integrally formed with a pair of pins 76 and 77 perpendicularly upstanding from the inside (or the arm member 21 and 22 adjacent) face 75 thereof. The pins 76 and 77 are positioned and sized for extending through each aperture 51 and 52, respectively. Each pin 76 and 77 further is received in and extends through respective aligned apertures 78 and 79 formed in the link member 29 and are engaged with such apertures. Thus, each arm 21 and 22 is pivoted relative to its associated pin 76 and 71 respectively.

Alternatively, the link members 28 and 29 can be similarly formed and each can be formed with a central aperture therethrough located centrally in each rounded opposite end region thereof. A steel pin can then be transversely extended through the opposing aligned apertures in the assembled device with the apertures 51 and 52 (of arms 21 and 22) positioned therebetween for pivotability of the arms 21 and 22.

To provide a hand gripping means, a horizontally oriented handle 81 is preferably associated with link member 28. In the device 20, handle 81 has inturned terminal opposite end portions which each terminate in a projecting mounting post that is received in and mounted to a different aligned receiving channel 82 and 83 formed in the link member 28. Alternatively, the end of each inturned opposite end can abut against link member 28 and an aligned mounting screw can extend through link member 28 into aligned, threaded engagement with each handle opposite end. For ease in user gripping, the upper gripping surface of the handle 81 is preferably provided with a ribbed configuration for user hand receiving and locating purposes. Similarly, opposite side edge medial portions of each arm 21 and 22 are preferably and as shown each provided with a ribbed configuration for user hand receiving and locating purposes (see FIGS. 7 and 8). Various other types of handle means can be provided.

The inside face of link member 28 is preferably further provided with circular outstanding ribs 86 and 87, each rib being adjacent a different respective opposite end thereof. Each rib 86 and 87 is discontinuous in the region of each channel 82 and 83, respectively. Each rib 86 and 87 is located in radially equally spaced relationship to its adjacent pin 76 and 77, respectively. The diameter and configuration of each rib 86 and 87 is preferably such that it is adapted to abut slidably against the surface of each proximal end region 23 and 24 with its circumferential outside surfaces being adjacent to and slidably movable relative to the inside surfaces of adjacent portions of the peripheral flange 43 and 44, respectively.

To limit pivotal travel of each arm 21 and 22 relative to link member 28, two upstanding posts 88 and 89 are preferably provided at each proximal end region 23 and 24 in the region between the peripheral flange 43 and 44 and aperture 51 and 52, respectively. Also, the inside face of link member 28 is preferably provided with an upstanding stud 84 located between each pin 76 and 77 and its adjacent respective rib 86 and 87. The positional relationship between the studs 84 and the posts 88 and 89 is such that each post 88 and 89 abuts against its adjacent stud 84 in a proximal end region 23 or 24 when a predetermined pivotal travel of arm 21 or 22 relative to link member 28 is reached. The link member 29 is also preferably provided with corresponding circular upstanding ribs 86 and 87 and studs 84 and the opposite side of each proximal end region 23 and 24 is also preferably provided with corresponding posts 88 and 89. The preferred bilateral symmetrical relationship between the arms 21 and 22 and the link members 28 and 29 is thus maintained during pivotal movements of the arms 21 and 22 relative to the link members 28 and 29.

Figure 3:
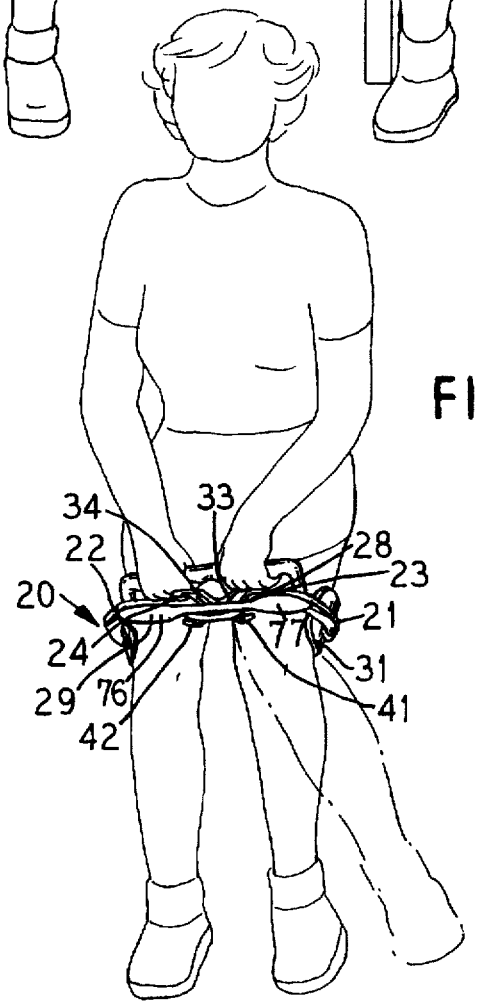
FIG. 3 is an environmental perspective view in diagrammatic form illustrating a further method of using the exercise device embodiment of FIGS. 1 and 2 to develop thighs, hips and buttocks muscles.
Figure 6:
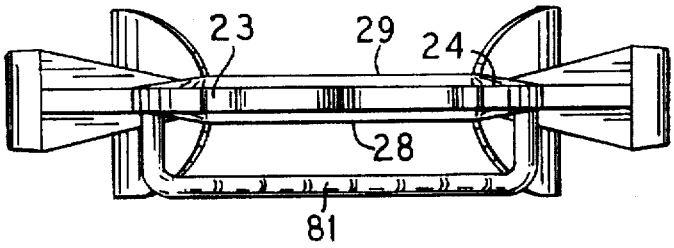
FIG. 6 is a top plan view of the device embodiment of FIG. 4.

The device 20 in FIG. 3 is illustratively shown in its operative configuration where each plate member 31 and 32 is adapted to be moved towards the other as each proximal end 23 and 24 is concurrently pivotably moved inwardly relative to link members 28 and 29. When the lower ends 41 and 42 of each tree member 33 and 34 have extended therebetween compression biasing means, the lower ends 41 and 42 are preferably yieldingly urged together. A torque force is thus exerted on arms 21 and 22 in the region of the pins 76 and 77 which results in pivotal movements of plates 31 and 32 towards one another.

The device 20 in FIG. 10 is illustratively shown in its operative configuration where each plate 31 and 32 is adapted to be moved away from the other as each proximal end 23 and 24 is concurrently pivotably moved outwardly relative to link members 28 and 29. When the upper ends 38 and 39 of each tree member 33 and 34 have extended therebetween compression biasing means, the upper ends 38 and 39 are preferably yieldingly urged together. A torque force is thus exerted on arms 21 and 22 in the region of the pins 76 and 77 which results in pivotal movements of plates 31 and 32 away from one another.

The same compression biasing means preferably and as desired, that is applied between the lower end portions 41 and 42 is also applied between the upper end portions 38 and 39.

It is much preferred in the practice of this invention to employ as the compression biasing means a closed (or endless) loop or band 91 of elastomeric (or rubber-like) material which is adapted to exert a yielding compression force (or contraction force) when extended (or stretched) and which is further adapted to return substantially to its initial or relaxed configuration after release from extension. Preferably a band 91 exerts a uniform compression force when extended over a relatively wide range of extension distances.

Those skilled in the art will readily appreciate that device 20 can be operated with different bands 91 such that a progressive or systematic increase in tensioning force capability between adjacent end portions of tree members 33 and 34 is achievable. Selection of band 91 length can be used, if desired, to regulate or select the arms 21 and 22 position where compression force begins to be applied between tree members 33 and 34.

As an alternative, and as those skilled in the art will readily appreciate, a metallic compression spring, such as a coiled steel spring, can be utilized, if desired.

Figure 2:
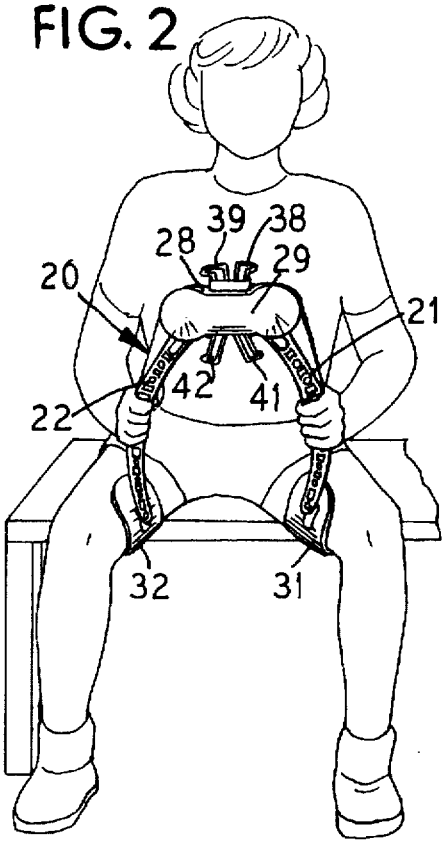
FIG. 2 is an environmental perspective view in diagrammatic form illustrating one method of using the exercise device embodiment of FIG. 1 to develop thigh lateral compression (adductors) muscles.

The device 20 makes possible the achievement of new and improved methods for exercising the thighs and buttocks of one who exercises. In the practice of one method, variations of which are illustrated in FIGS. 1 and 2, one pivots the arm members 21 and 22 inwardly so that the tree lower end portions 41 and 42 are adjacent each other. Next, one positions an elastomeric band member 91 over the tree lower end portions 41 and 42.

Next, one laterally pivots the arm members 21 and 22 outwardly against the yielding compression bias provided by the band member 91. One positions the arm members 21 and 22 perpendicularly relative to said thighs with the link members 28 and 29 being outward (so as to be positioned remotely relative to the thighs). Also, one positions each one of the plate members 31 and 32 against a different respective opposed outside portion of each thigh whereby said thighs are laterally urged together (see FIG. 1). Particularly, these last three steps can be performed concurrently or in any desired sequence.

Then, one activates the muscles in the thighs so as to at least equal the yielding compression bias provided by the band member 91. In such activating, the thigh muscles may be controlled by one so as to cyclically move the thighs inwards and outwards, if desired. As illustrated in FIG. 3, for example, one leg can be laterally and backwards while the other leg remains stationary and body supportive.

After such thigh muscle activating, and muscle exercising, the arm members 21 and 22 are inwardly pivoted so that the tree lower end portions 41 and 42 are adjacent each other. Then, the elastomeric band member 91 is separated from the tree lower end portions 41 and 42.

In the practice of a second method, a variation of which is illustrated in FIG. 3, one laterally pivots the arm members 21 and 22 outwardly so that the tree upper end portions 38 and 39 are adjacent each other. Next, one positions an elastomeric band member 91 over the tree upper end portions 38 and 39.

Next, one laterally pivots the arm members 21 and 22 inwardly against the yielding compression bias provided by the band member 91. One positions the arm members 21 and 22 perpendicularly relative to the thighs with the link members 28 and 29 being outward remotely (so as to be positioned relative to the thighs). Also, one positions each one of the plate members 31 and 32 against a different respective opposed inside portion of each thigh whereby the thighs are laterally urged apart. Particularly, these last three steps can be performed concurrently or in any desired sequence.

Then, one activates the muscles in the thighs and buttocks so as to at least equal the yielding compression bias of the band member 91. In such activating, the thigh muscles may be controlled by one so as to cyclically move the thighs inwards and outwards, if desired.

The exerciser can perform the first above-indicated method and then the second above-indicated method, or vice versa, in a sequential manner so as to accomplish a thigh balanced exercise pattern.

The inventive device is well suited for exercise and development of inner thigh outer thigh and buttocks muscles.

Although the device and methods provided by present invention have been herein shown and described in reference to a particular and preferred embodiments thereof, those skilled in the art will appreciate readily that other and further methods and apparatus embodiments and component variations and changes can be made without departing from the spirit and scope of the present invention.

What is claimed is:

1. An exercise device for thighs comprising:

a pair of elongated arms, each one having a proximal end region and a distal end region;

each proximal end region having an upwardly extending portion and a downwardly extending portion;

at least one link pivotably interconnecting each of the proximal end regions so that the arms are articulatable relative to one another; and a pair of body engagable plates, each plate being associated with a different one of the distal end regions; and whereby, when a yielding compression biasing member interconnects the respective upwardly extending portions, then the arm distal ends are each urged to articulate outwards relative to each other, and, when a yielding compression biasing member interconnects, the respective downwardly extending portions, then the arm distal ends are each urged to articulate inwards relative to each other.

2. The device of claim 1 wherein either the respective upwardly extending portions or the respective downwardly extending portions are interconnected together by a yielding compression biasing member.

3. The device of claim 1 wherein each plate is pivotably connected with the associated distal end region.

4. An exercise device for thighs comprising:

a pair of elongated arms, each one having a proximal end region and a distal end region;

at least one link pivotably interconnecting each of the proximal end regions so that the arms are laterally articulatable relative to one another;

a pair of body engagable plates, each plate being associated with a different one of the distal end regions; and a pair of arcuately extending trees, a mid-region of each tree being fixedly joined to a different one of each arm proximal end regions so that an upper end portion of each tree extends outwardly beyond the at least one link and a lower end portion of each tree extends inwardly beyond the at least one link;

whereby, when a yielding compression biasing member interconnects the respective tree upper end portions, then the arm distal ends are each urged to move pivotably outwards relative to each other, and, when the yielding compression biasing member interconnects the respective tree lower end portions, then the arm distal ends are each urged to move pivotably inwards relative to each other.

5. The device of claim 4 wherein the yielding compression biasing member is interconnected between an opposite end portion of each tree.

6. The device of claim 5 wherein the yielding compression biasing member is an elastomeric band.

7. The device of claim 4 wherein the yielding compression biasing member is interconnected between one end portion of each tree.

8. The device of claim 5 wherein the yielding compression biasing member is an elastomeric band.

9. The device of claim 4 wherein each plate is pivotably connected with its associated distal end region.

10. The device of claim 4 wherein at least one link comprises a pair of generally flattened members located in adjacent spaced parallel relationship to one another with each of the arm proximal ends and their respective trees being positioned therebetween, the flattened members including a laterally spaced pair of pins extending therebetween with the proximal end region of each arm being pivotably associated with a different one of said pins.

11. The device of claim 10 wherein each of said flattened members includes a circular outstanding rib means that slidably and adjacently concentrically engages a circularly extending flange means that is provided in each arm's proximal end region.

12. The device of claim 4 wherein the link is associated with a laterally extending handle including link fasteners therefor.

13. The device of claim 12 wherein the handle includes a plurality of finger receiving grooves on defined in an upper edge portion thereof.

14. The device of claim 4 wherein each of arms is convexly laterally outwardly curved between the proximal end region and the distal end region thereof.

15. The device of claim 4 wherein each of the arms has a medially thickened region along its length.

16. The device of claim 4 wherein each of the arms is provided with a plurality of finger receiving grooves defined in a medial portion thereof.

17. The device of claim 4 which includes stop means for limiting pivotal movement between the link and the arms.

18. As an article of manufacture, a kit comprising:

an exercise device of claim 4;

a plurality the yielding compression biasing members, each of these members comprising a different elastomeric band; and at least one containment member for the exercise device aid the plurality of yielding compression biasing members.

19. An exercise device for thighs comprising:

(A) a pair of elongated arms, each one having a proximal end region and a distal end region;

(B) a pair of arcuately extending trees, a mid-region of each tree being fixedly associated across a different one of the arm proximal end regions so that an upper end portion of each tree extends upwardly and a lower end portion of each tree extends downwardly relative to the associated arm proximal end region, said trees and respective associated arm proximal end regions being in spaced, adjacent, generally coplanar relationship relative to each other;

(C) a pair of generally flattened, laterally elongated link members located in adjacent spaced parallel relationship to one another with each of the arm proximal ends and their respective associated trees being positioned therebetween, these link members including a pair of pins extending therebetween and each pin extending through a different one of said proximal ends whereby each arm is pivotable relative to the other arm; and (D) a pair of plate members, each plate member being pivotably associated with a different one of the distal end regions, each plate member having one face configured or making contacting engagement with a thigh portion;

the interrelationship between said arms, said trees, said link members and said plate members being such that;

(a) when each plate member is outwardly oriented in generally opposed relationship relative laterally to the other and a yielding compression biasing member interconnects the upper end portion of each tree, then the arm distal ends are each urged to move pivotably and laterally outwards relative to each other, and (b) when each plate member is laterally inwardly oriented in generally opposed relationship relative to the other, and a yielding compression biasing member interconnects the lower end portion of each tree, then the arm distal end regions are each urged to move pivotably and laterally inwards relative to each other.

20. The device of claim 19 wherein either the respective upper end portion of each tree or the respective lower end portion of each tree are interconnected together by an elastomeric band.

21. A method for exercising the thighs of an exerciser using a device of claim 4, said method comprising the steps of:

(A) pivoting said arms inwardly so that the respective tree lower end portions are adjacent each other;

(B) positioning an elastomeric band member over the tree respective lower end portions;

(C) laterally pivoting the arms outwardly against the yielding compression bias provided by the band member;

(D) positioning the arms generally perpendicularly to the thighs with the at least one link outward;

(E) positioning each one of the plates against a different opposed outside portion of each thigh whereby the thighs are laterally urged together; and (F) activating the muscles in the thighs so as to at least equal the yielding compression bias provided by the band member.

22. The method of claim 21 wherein said steps (C), (D) and (E) are practical concurrently.

23. The method of claim 21 wherein said steps (C), (D) and (E) are practical in any chosen sequence.

24. The method of claim 21 wherein in the activating step, the thigh muscles are controlled by the exerciser so at to cyclically move the thighs inwards and outwards at least once.

25. The method of claim 21 wherein, after the activating step, the arms are first inwardly pivoted so that the respective tree lower end portions are adjacent each other and then the elastomeric band member is separated from the tree respective lower end portions.

26. The method of claim 25 wherein, after the elastomeric band member is so separated, then the following further steps are carried out:

(A) the arm means are pivoted outwardly so that tree upper end portions are adjacent each other;

(B) an elastomeric band member is positioned over the tree respective upper end portions;

(C) the arms are pivoted inwardly against the yielding compression bias provided by the band member;

(D) the arms are oriented generally perpendicularly to the thighs with the at least one link being remote relative to the thighs;

(E) each one of the plates is positioned against a different respective opposed inside portion of each thigh whereby the thighs are laterally urged apart; and (F) the muscles in the thighs are activated so as to at least equal the yielding compression bias provided by the band member.

27. A method for exercising the thighs of an exerciser using a device of claim 4, said method comprising the steps of:

(A) pivoting the arms inwardly so that the respective tree upper end portions are adjacent each other;

(B) positioning an elastomeric band member over the tree respective upper end portions;

(C) laterally pivoting the arms inwardly against the yielding compression bias provided by the band member;

(D) positioning the arms perpendicularly to the thighs with the at least one link being remote relative to the thighs;

(E) positioning each one of the plates against a different respective opposed inside portion of each thigh whereby the thighs are laterally urged apart; and (F) activating the muscles in the thighs so as to at least equal the yielding compression bias provided by the band member.

28. The method of claim 27 where in the activating step, the thigh muscles are controlled by the exerciser so as to cyclically move the thighs inwards and outwards at least once.

29. The method of claim 27 wherein, after the activating step, the arms are first outwardly pivoted so that the respective tree upper end portions are adjacent each other and then the elastomeric band member is separated from the tree respective lower end portions.

30. The method of claim 29 wherein, after the elastomeric band member is so separated, the following further steps are carried out:

(A) the arms are pivoted inwardly so that the respective tree lower end portions are adjacent each other;

(B) an elastomeric band member is positioned over the respective tree lower end portions;

(C) the arms are laterally pivoted outwardly against the yielding compression bias provided by the band member;

(D) the arms are oriented perpendicularly to said thighs with the at least one link being outward;

(E) each one of the plates is positioned against a different opposed outside portion of each thigh whereby the thighs are laterally urged together; and (F) activating the muscles in the thighs so as to at least equal the yielding compression bias provided by the band member.

* * * * *